US006054956A

United States Patent [19]

Mandai et al.

[11] Patent Number: 6,054,956

[45] Date of Patent: Apr. 25, 2000

[54] ANTENNA UNIT HAVING POWER RADIATION CONDUCTOR

[75] Inventors: Harufumi Mandai, Takatsuki; Teruhisa Tsuru, Kameoka, both of Japan

[73] Assignee: Murata Manufacturing Co., Ltd., Japan

[21] Appl. No.: 08/803,626

[22] Filed: Feb. 21, 1997

[30] Foreign Application Priority Data

Feb. 21, 1996 [JP] Japan ..... 8-033779

[51] Int. Cl.[7] ..... H01Q 1/38; H01Q 1/24

[52] U.S. Cl. ..... 343/702; 343/700 MS; 343/873

[58] Field of Search ..... 343/700 MS, 702, 343/895, 873; H01Q 1/38, 1/24

[56] References Cited

U.S. PATENT DOCUMENTS

| | | | |
|---|---|---|---|
| 4,888,597 | 12/1989 | Rebiez et al. | 343/778 |
| 5,185,613 | 2/1993 | Whatmore et al. | 343/909 |
| 5,262,791 | 11/1993 | Tsuda et al. | 343/700 |
| 5,450,090 | 9/1995 | Gels et al. | 343/700 MS |
| 5,585,807 | 12/1996 | Takei | 343/702 |
| 5,649,306 | 7/1997 | Vannatta et al. | 343/702 |

FOREIGN PATENT DOCUMENTS 473981 3/1992 European Pat. Off. .

OTHER PUBLICATIONS

Patent Abstracts of Japan, vol. 008, No. 099 (E–243), May 10, 1984 & JP 59 017705 A. Jan. 30, 1984.

Patent Abstracts of Japan, vol. 018, No. 311 (E–1561), Jun. 14, 1994 & JP 06 069057 A, Mar. 11, 1994.

*Primary Examiner*—Hoanganh Le

*Attorney, Agent, or Firm*—Ostrolenk, Faber, Gerb & Soffen, LLP

[57] ABSTRACT

An antenna unit which has a high gain and a wide bandwidth at a low resonance frequency thereof. The antenna unit comprises an antenna body and a power radiation electrode. The antenna body comprises a rectangular-prism-like substrate comprising a dielectric material, whose major ingredients are e.g., barium oxide, aluminum oxide and silica. A power supply conductor is provided in the substrate and is made of copper or copper alloy and is wound in a spiral in the direction of height of the substrate. A power supply terminal for applying a voltage to the power supply conductor is provided on a surface of the substrate. Further, a power radiation electrode, which comprises, e.g., a nearly rectangular metallic plate made of copper, copper alloy or aluminum, is provided on the surface of the substrate of the antenna body. This power radiation electrode is electrically isolated from the power supply conductor.

31 Claims, 8 Drawing Sheets

ANTENNA UNIT HAVING POWER RADIATION CONDUCTOR

BACKGROUND OF THE INVENTION

1. Field of the Invention

The present invention generally relates to an antenna unit and, more particularly, to an antenna unit for use in a mobile communication system and in a local area network (LAN).

2. Description of the Related Art

FIG. 12 is a side view of a conventional tip antenna. The tip antenna 50 consists of: a rectangular-prism-like insulator 51 formed by stacking up insulating layers (not shown) made of powdery insulating materials such as alumina and steatite; a conductor 52 which is made of silver or silver-palladium alloy or the like and is formed like a coil in the insulator 51; a magnetic element 53 which is made of magnetic powder such as ferric powder and is formed inside the insulator 51 and the coil-like conductor 52; external connecting terminals 54*a* and 54*b* which are made to adhere and are baked in such a manner as to stick to the lead-out end (not shown) of the conductor 52 after the firing of the insulator 51. Namely, the tip antenna 50 is configured so that the coil-like conductor 52 is wound around the magnetic element 53 and a space therearound is filled with the insulator 51. Further, by using a material having a low relative permeability as the magnetic element 53, a tip antenna 50 which has a low resonance frequency of tens to hundreds MHz can be produced.

However, the aforementioned conventional tip antenna has a problem in that when produced as a small-sized antenna having a low resonance frequency, the gain and bandwidth thereof are degraded.

The present invention is accomplished to solve such a problem of the conventional tip antenna.

Accordingly, an object of the present invention is to provide an antenna unit which has a high gain and a wide bandwidth at a low resonance frequency.

SUMMARY OF THE INVENTION

To achieve the foregoing and other objects, in accordance with an aspect of the present invention, there is provided an antenna unit that comprises: an antenna body comprising a substrate comprising at least one of a dielectric material and a magnetic material; at least one power supply conductor arranged on at least one of a surface and an inner portion of the substrate; the antenna body having on a surface of the substrate at least one power supply terminal for applying a voltage to the power supply conductor; and at least one power radiation conductor provided in proximity to a surface of the substrate of the antenna body.

Further, to attain the foregoing and other objects, in accordance with another aspect of the present invention, there is provided an antenna unit that comprises: an antenna body comprising a substrate comprising at least one of a dielectric material and a magnetic material; at least one power supply conductor arranged on at least one of a surface and an inner portion of the substrate; the antenna body having on a surface of the substrate at least one power supply terminal for applying a voltage to the power supply conductor; and at least one power radiation conductor provided in proximity to electronic equipment on which the antenna unit is mounted.

Thus, the antenna unit according to the present invention is provided with a power supply conductor and a power radiation conductor. Therefore, the power radiation conductor can be operated as a radiating plate (namely, a radiator). Moreover, the power supply conductor can be operated as an exciter.

In the antenna unit of the present invention, the power radiation conductor operates as a radiating plate, while the power supply conductor operates as an exciter. Thus, there is electromagnetic coupling between the power radiation conductor and the power supply conductor. Consequently, in comparison with the conventional antenna unit, at a low resonance frequency, a higher gain and a wider bandwidth can be obtained.

Other features and advantages of the present invention will become apparent from the following description of the invention which refers to the accompanying drawings.

BRIEF DESCRIPTION OF THE DRAWINGS

FIG. 7(*b*) is a sectional view of a third modification of the electronic device of FIG. 4;

FIG. 10(*b*) is a sectional view of a second modification of the electronic device of FIG. 8;

FIG. 11(*b*) is a sectional view of a fourth modification of the electronic device of FIG. 8.

DETAILED DESCRIPTION OF EMBODIMENTS OF THE INVENTION

Figure 1:
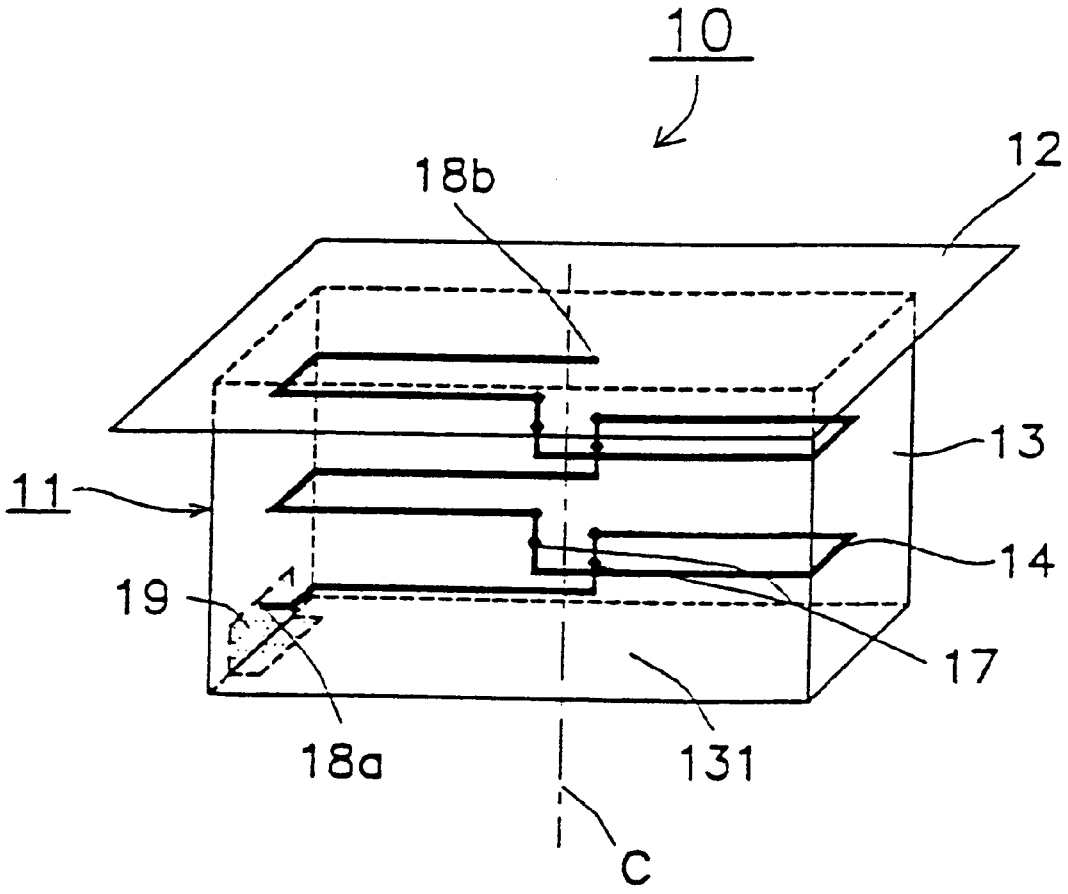
FIG. 1 is a perspective view of an antenna unit according to the present invention, which is a first embodiment of the present invention.

Hereinafter, the preferred embodiments of the present invention will be described in detail by referring to the accompanying drawings. Incidentally, in the following description of the preferred embodiments, like reference numerals designate like or corresponding portions of the first embodiment of the present invention. Thus, the detailed description of such portions is omitted.

Figure 2:
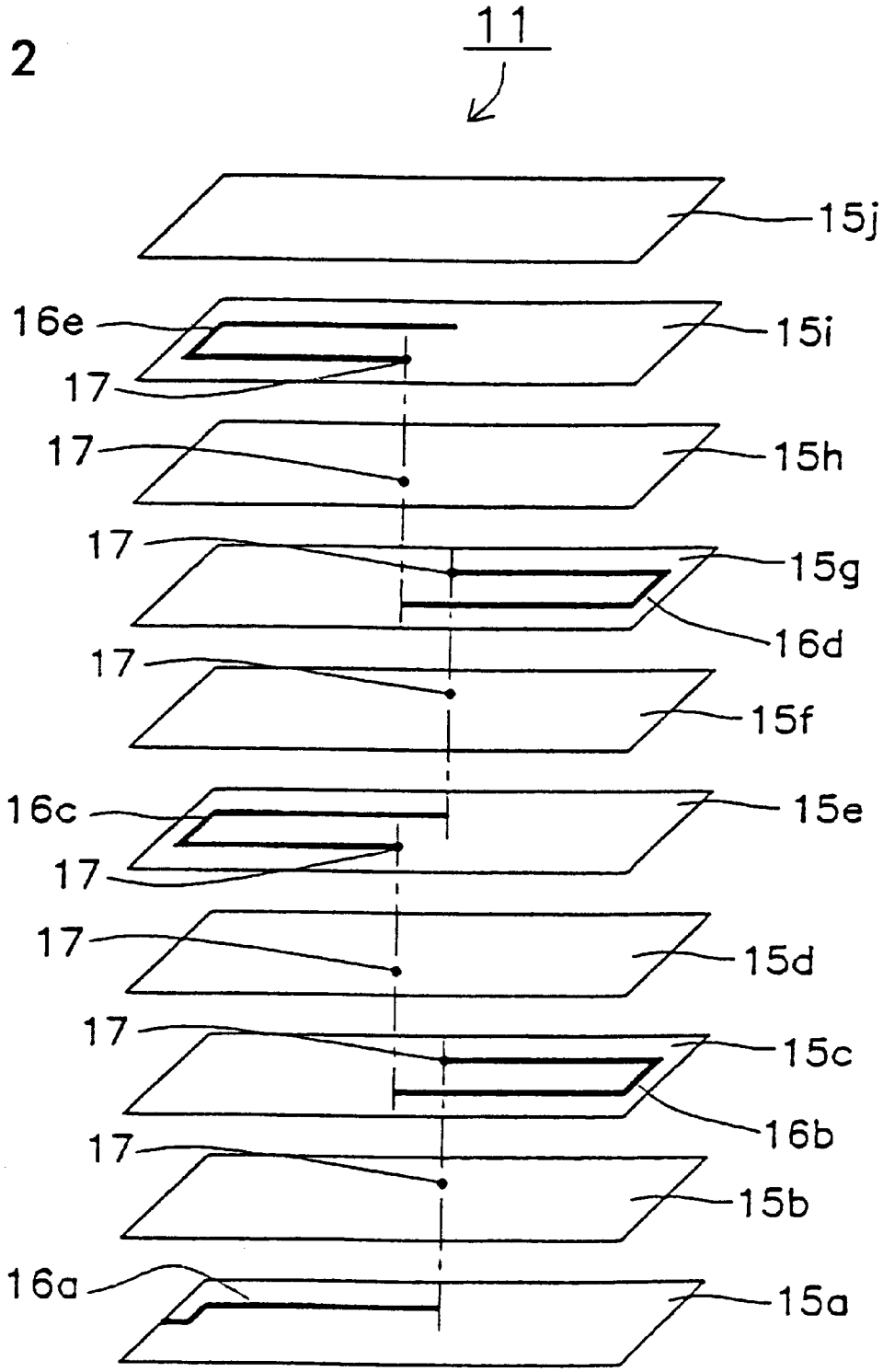
FIG. 2 is an exploded perspective view of the antenna (main) body of the antenna unit of FIG. 1.

FIG. 1 and FIG. 2 are, respectively, a perspective view and an exploded perspective view of an antenna unit according to the present invention, which is the first embodiment of the present invention.

The antenna unit 10 consists of an antenna body 11 and a power radiation conductor 12. The antenna body 11 is provided with a power supply conductor 14, which has a winding axis C extending in a direction perpendicular to the mounting surface 131, namely, which is wound in a spiral in the direction of height of the substrate 13, in a rectangular-prism-like substrate 13 which has a mounting surface 131. In this embodiment, the base element 13 is formed by stacking up rectangular sheet layers 15*a* to 15*j*, each of which is made of a dielectric material, e.g. whose major ingredients are barium oxide, aluminum oxide and silica (relative permittivity is about 6.1).

Among these sheet layers, the sheet layers 15*a*, 15*c*, 15*e*, 15*g* and 15*i* have surfaces on which nearly-L-shaped or nearly-U-shaped conductive patterns 16*a* to 16*e* are provided by performing e.g., printing, vapor deposition, laminating or plating. Moreover, via holes 17 are formed at predetermined positions on the sheet layers 15*b* to 15*i* (namely, at an end of each of the conductive patterns 16*a* to 16*e* and at positions on these sheet layers respectively corresponding thereto).

Furthermore, the sheet layers 15*a* to 15*j* are stacked and sintered. In addition, the conductive patterns 16*a* to 16*e* are connected through the via holes 17. Thereby, a power supply conductor 14, which is wound in a spiral in the direction of height of the substrate 13 in such a manner that each of the windings has a rectangular section, is formed in the substrate 11.

An end portion of the power supply conductor 14 (namely, an end portion of the conductive pattern 16*a*) is drawn out of the substrate 13 to a surface thereof and comprises a power supply portion 18*a*. Further, this end portion of the power supply conductor 14 is connected to a power supply terminal 19 that is formed on the surface of the substrate 13 in order to apply a voltage to the power supply conductor 14. The other end portion of the power supply conductor 14 (namely, an end portion of the conductive pattern 16*e*) comprises a free end 18*b* in the substrate 13.

Subsequently, the power radiation conductor 12 comprising a nearly rectangular metallic plate made of, for example, copper, copper alloy or aluminum is fixedly mounted onto the substrate 13. The power radiation conductor 12 is electrically isolated from the power supply conductor.

Figure 3:
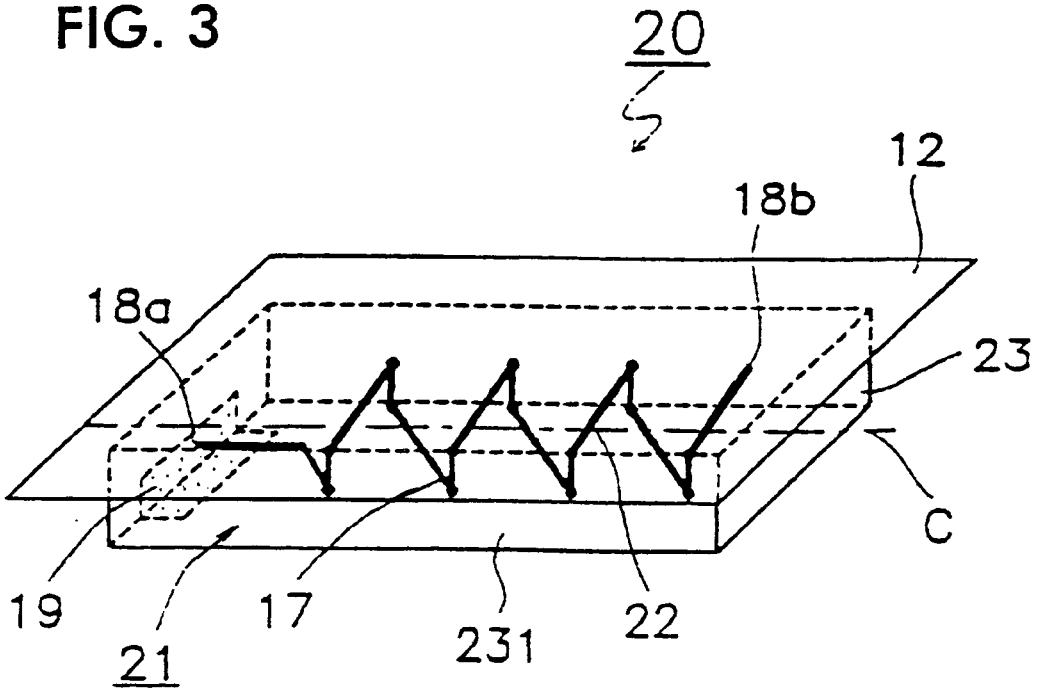
FIG. 3 is a perspective view of another antenna unit according to the present invention, which is a second embodiment of the present invention.

FIG. 3 is a perspective view of another antenna unit according to the present invention, which is a second embodiment of the present invention.

As compared with the antenna unit 10, the antenna unit 20 is different from the antenna unit 10 in that a power supply conductor 22 is wound such that the winding axis C of the power supply conductor 22 of the antenna body 21 is parallel to a mounting surface 231, namely, the power supply conductor 22 is wound in a spiral in the longitudinal direction of a substrate 23.

As above described, each of the antenna units 10 and 20 has a corresponding one of spiral power supply conductors 14 and 22 a further has a nearly rectangular power radiation conductor 12. Further, there is provided electromagnetic coupling between the power supply conductor 14 or 22 and the power radiation conductor 12. Thus, there is generated capacitance between the power radiation conductor 12 and a ground electrode (not shown). Consequently, the antenna units 10 and 20 become antennas, each of which has a low resonance frequency.

Next, cases in which the antenna units 10 and 20 are mounted on electronic devices, will be described hereinbelow.

Figure 4:
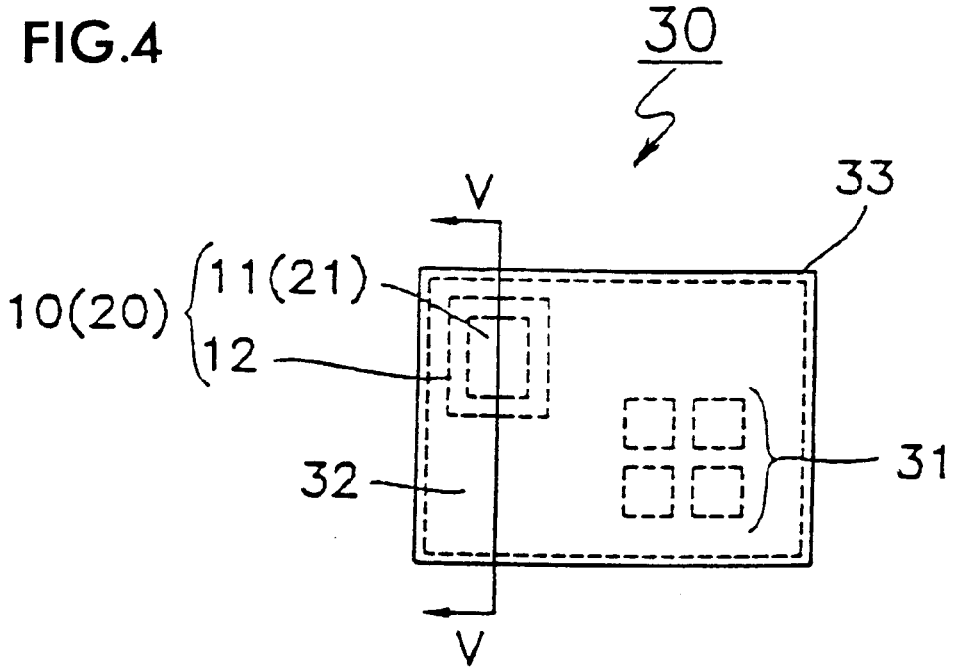
FIG. 4 is a front view of an electronic device on which the antenna units of FIGS. 1 and 3 are mounted.
Figure 5:
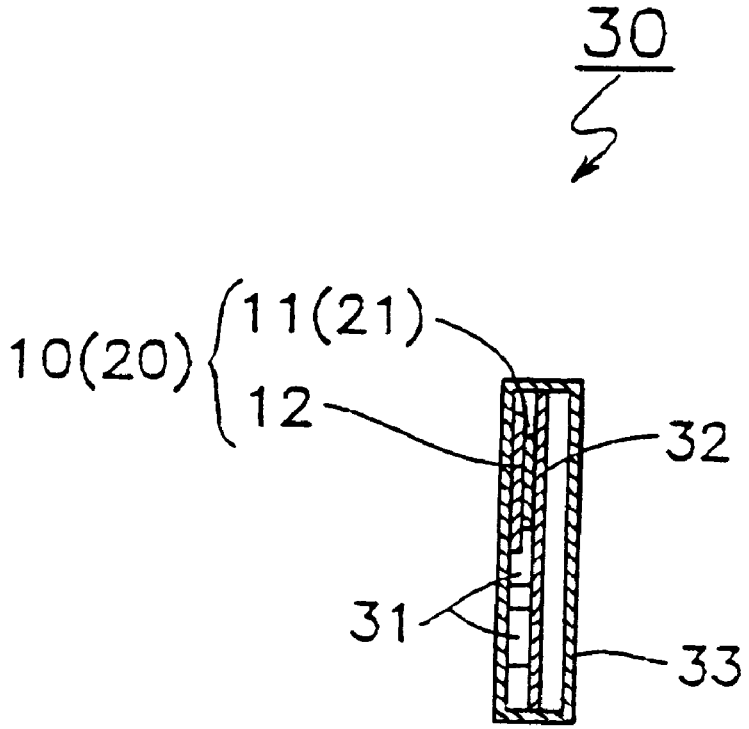
FIG. 5 is a sectional view of the electronic device taken in the direction of the arrows on line V—V of FIG. 4.

FIG. 4 and FIG. 5 are, respectively, a top view and a sectional view of an electronic device on which the antenna unit 10 or 20 is mounted.

The antenna unit 10 (20) is mounted on a printed circuit board 32 on which electronic parts composing an RF control portion 31 of an electronic device 30 are mounted. The antenna unit 10 (or 20) is connected to the RF control portion 30 through a transmission line (not shown) or the like.

Further, the printed circuit board 32, on which the antenna unit 10 (or 20) is mounted, is placed in a casing 33 of the electronic device 30. The power radiation conductor 12 of the antenna unit 10 (or 20) may be in contact with the casing 33 thereof but need not be in contact therewith.

Figure 6:
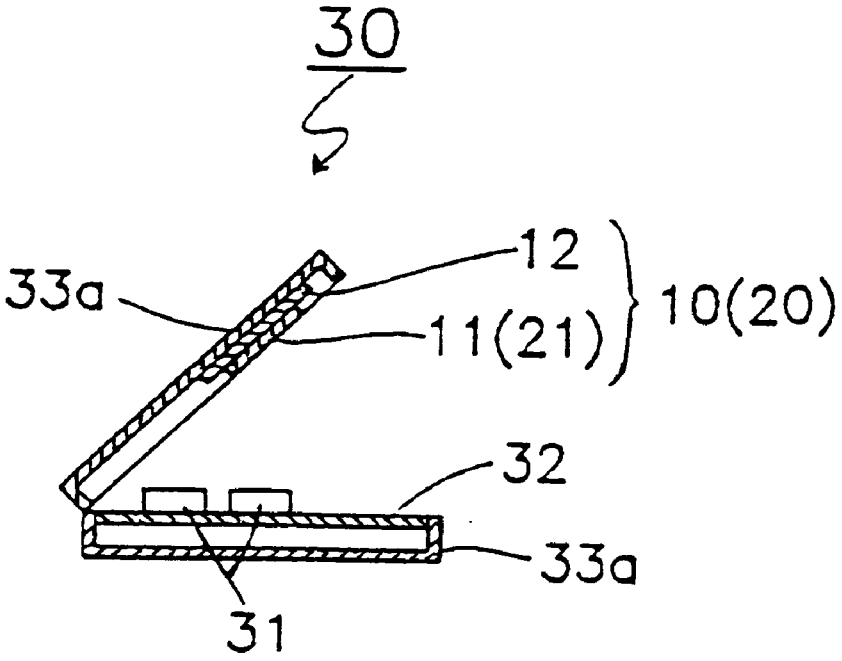
FIG. 6 is a sectional view of a first modification of the electronic device of FIG. 4.

FIG. 6 is a sectional view of a modification of the electronic device in a case that the antenna unit 10 (or 20) is mounted thereon.

In the case of this modification, the casing 33 of the electronic device 30 comprises a carrying case 33*a* and a cover or lid 33*b* reclosably connected to the carrying case 33*a*. Further, the printed circuit board 32, on which the RF control portion 31 of the electronic device 30 is mounted, is provided in the carrying case 33*a*. Moreover, the antenna unit 10 (or 20) is provided on the back surface of the cover 33*b*. The antenna unit 10 (or 20) is connected to the RF control portion 31 of the electronic device 30 through a cable (not shown) or the like.

In this case, the antenna unit 10 (or 20) can be disposed in an orientation in which radiation reception/transmission is optimum.

Incidentally, FIG. 6 illustrates the usage conditions of the electronic device. Usually, the electronic device is carried in a state in which the cover 33*b* is put on the carrying case 33*a*. Further, the electronic device may be used in a state in which the cover 33*b* is down on the carrying case 33*a*. Moreover, the electronic device may be used in a state, in which the cover 33*b* is detached therefrom, by preliminarily putting the carrying case 33*a* and the cover 33*b* in a detachable state.

Figure 7A:
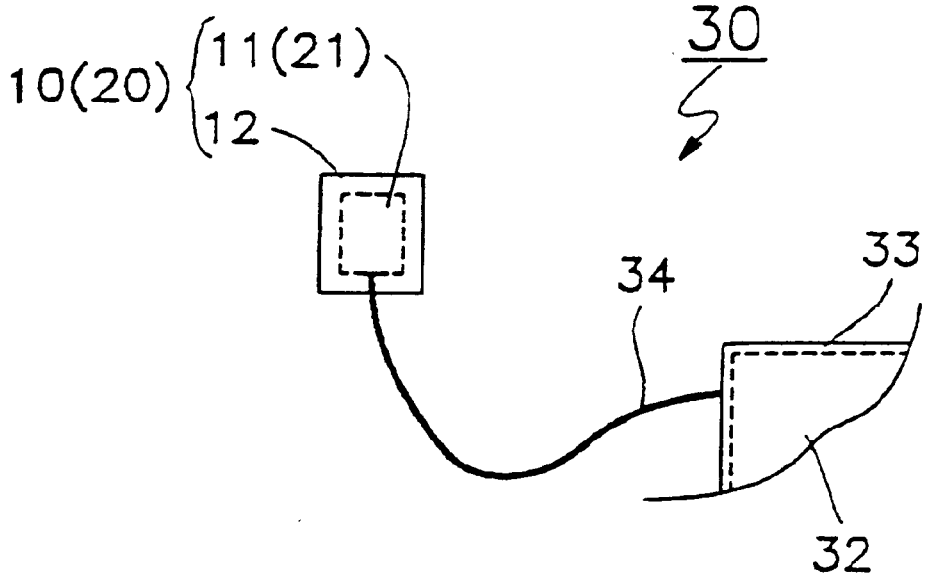
FIG. 7(*a*) is a sectional view of a second modification of the electronic device of FIG. 4.
Figure 7B:
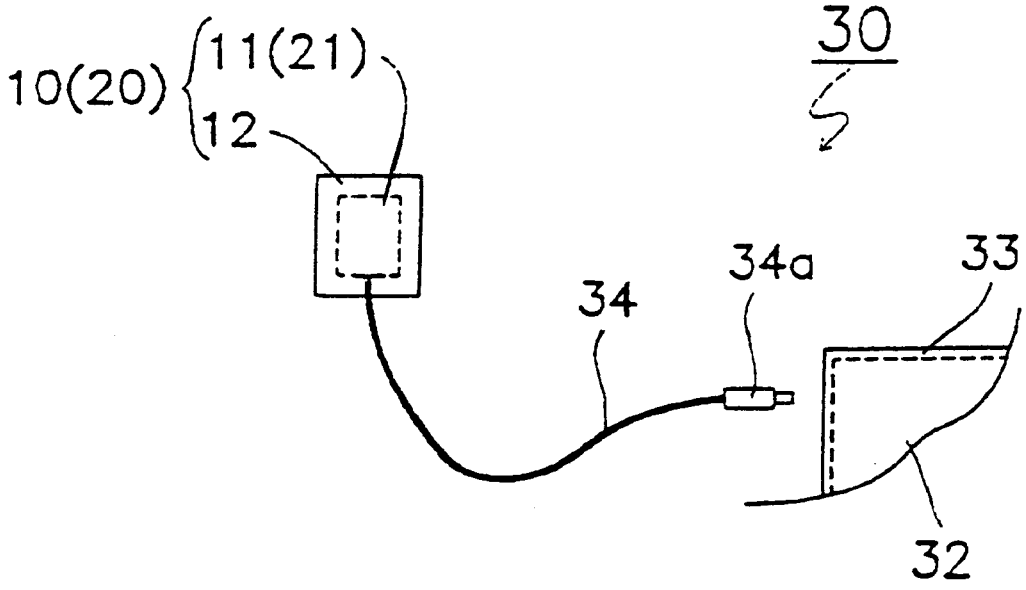

FIGS. 4 to 6 illustrate the case that the antenna unit 10 (or 20) is placed in the casing 33 of the electronic device 30. As shown in FIG. 7(*a*), the antenna unit 10 (or 20) may be externally provided and added to the device 30 through a cable 43. In this case, the antenna unit 10 (or 20) can be installed at a place where radiation reception/transmission is best.

Moreover, a connector 34*a* may be attached to an end portion, which is at the side of the electronic device 30, of the cable 34. Furthermore, a connector (not shown) may be attached to the other end portion, which is at the side of the antenna unit 10 (or 20), of the cable 34. Alternatively, connectors (not shown) may be attached to both of the end portions, which are at the sides of the electronic device 30 and the antenna unit 10 (or 20), of the cable 34, respectively. In these cases, the antenna unit 10 (or 20) can be detached from the electronic device 30. Moreover, such electronic devices and antennas in these cases are convenient to carry.

Figure 8:
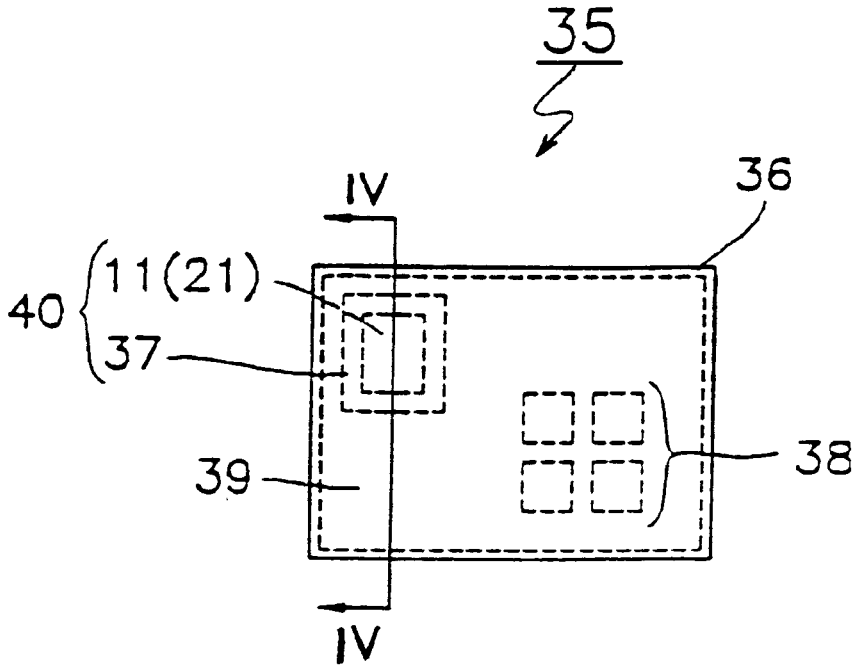
FIG. 8 is a front view of another electronic device, on which still another antenna unit according to the present invention, namely, a third embodiment of the present invention is mounted.
Figure 9:
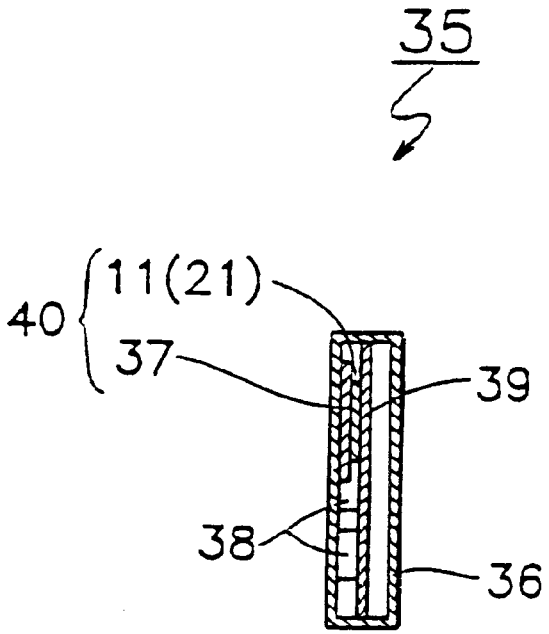
FIG. 9 is a sectional view of the electronic device taken in the direction of the arrows on line IV—IV of FIG. 7.

FIG. 8 and FIG. 9 are a front view and a sectional view of an antenna unit according to the present invention, which is a third embodiment of the present invention, respectively, in a case where the antenna unit is placed in an electronic device.

The electronic device 35 is configured by placing an antenna body 11 (or 21) in a casing 36. The casing 36 has a power radiation conductor 37 that comprises a nearly rectangular metallic plate formed by performing e.g., printing, vapor deposition, laminating or plating of copper, copper alloy or aluminum. This power radiation conductor 37 is electrically isolated from the casing and the power supply conductor.

The antenna body 11 (or 21) is mounted on a printed circuit board 39 on which electronic parts comprising an RF control portion of the electronic device 35 are also mounted. The antenna body 11 (or 21) is connected to the RF control portion 38 of the electronic device 35 through a transmission line (not shown) or the like. Further, the printed circuit board 39 is placed in the casing 36 of the electronic device 35.

As above described, in the case of the structure of the electronic device 35, an antenna unit 40 consists of the antenna body 11 (or 21) and the power radiation conductor 37 provided on the casing 36. Further, there is electromagnetic coupling between the power supply conductor 14 or 22 (FIG. 1 or FIG. 3), which is provided in the antenna body 11 or 21, and the power radiation conductor 37. Moreover, there is capacitance between the power radiation conductor 37 and the ground electrode (not shown). Consequently, the antenna unit comprises an antenna having a low resonance frequency.

Figure 10A:
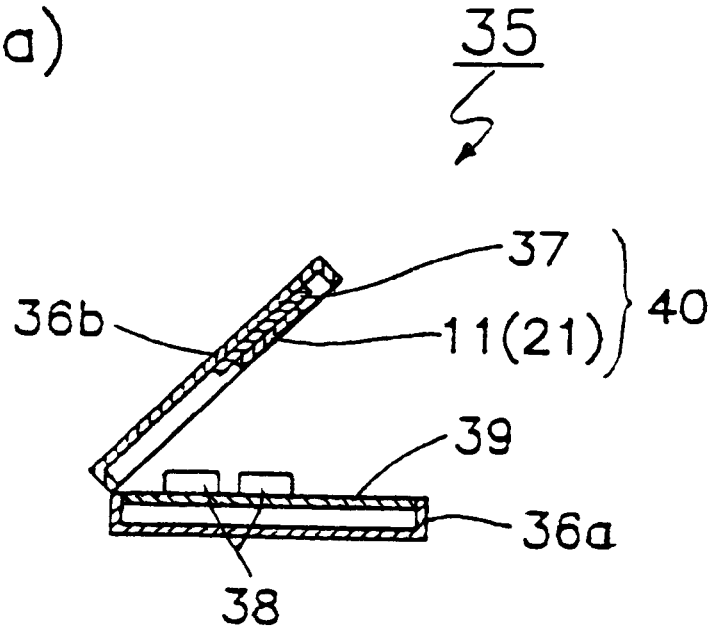
FIG. 10(*a*) is a sectional view of a first modification of the electronic device of FIG. 8.
Figure 10B:
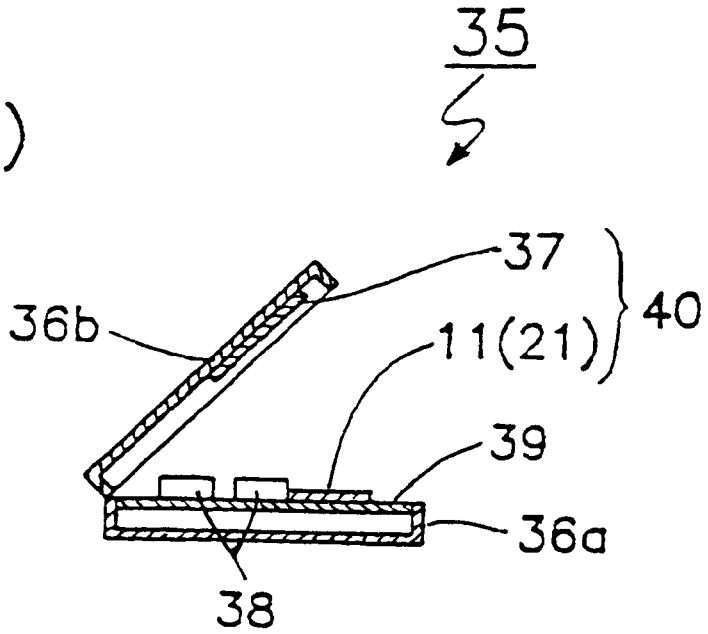

FIG. 10(*a*) and FIG. 10(*b*) are sectional views of first and second modifications of the antenna unit 40, which is the third embodiment of the present invention.

In the case of the modification of FIG. 10(*a*), the casing 36 of the electronic device 35 comprises a carrying case 36*a* and a cover 36*b* reclosably connected to the carrying case 36*a*. Further, a printed circuit board 39, on which an RF control portion 38 of the electronic device 30 is mounted, is provided in the carrying case 36*a*. Moreover, the antenna unit 11 (or 21) is provided on the back surface of the cover 36*b*. The antenna unit 11 (or 21) is connected to the RF control portion 38 of the electronic device 35 through a cable (not shown).

In the case of the modification of FIG. 10(*b*), the casing 36 of the electronic device 35 is comprises a carrying case 36*a* and a cover 36*b* reclosably connected to the carrying case 36*a*. Further, a printed circuit board 39, on which an RF control portion 38 of the electronic device 30 is mounted, is provided in the carrying case 36*a*. Moreover, the antenna unit 11 (or 21) is provided in the carrying case 36*a*. The power radiation conductor is provided on the cover 36*b*. The antenna unit 11 or 21 is connected to the RF control portion 31 of the electronic device 30 through a transmission line (not shown).

In these cases, the power radiation conductor 37 can be oriented in a position in which radio reception/transmission is optimum.

Incidentally, FIGS. 10(*a*) and 10(*b*) illustrate the usage conditions of the electronic device. Usually, the electronic device is carried with the cover 36*b* disposed on the carrying case 36*a*. Further, the electronic device may be used with the cover 36*b* disposed down on the carrying case 36*a*. Moreover, the electronic device may be used with the cover 36*b* detached therefrom, by preliminarily putting the carrying case 36*a* and the cover 36*b* in a detachable state.

Figure 11A:
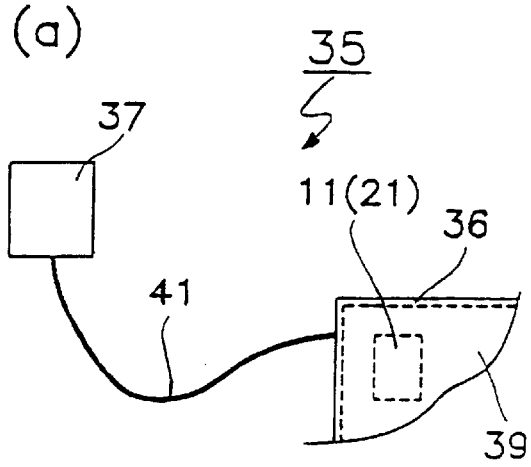
FIG. 11(*a*) is a sectional view of a third modification of the electronic device of FIG. 8.
Figure 11B:
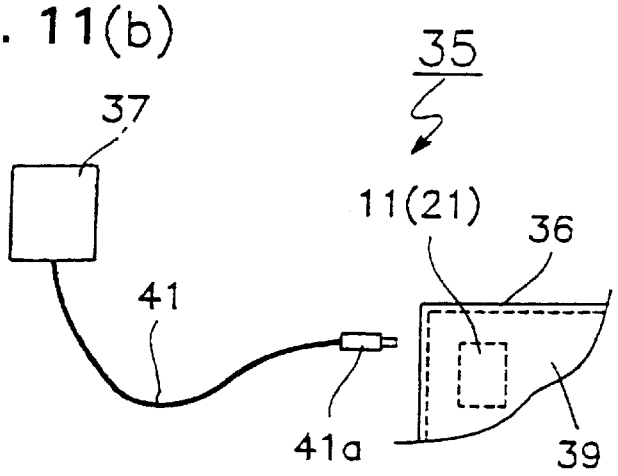
Figure 12:
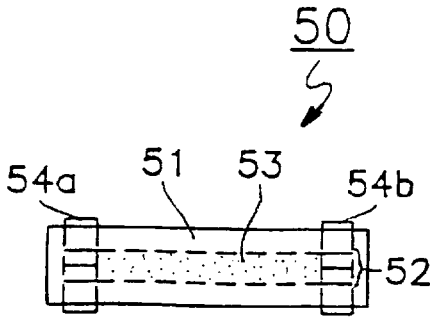
FIG. 12 PRIOR ART
FIG. 12 is a diagram showing the conventional antenna body.

FIGS. 8 to 10 illustrate the case that the power radiation conductor is placed in the casing 33 of the electronic device 35. As shown in FIG. 11(*a*), the power radiation conductor 37 may be externally provided and added to the device 35 through a cable 41. In this case, the power radiation conductor 37 can be installed at a location where radio reception/transmission is optimum.

Moreover, as illustrated in FIG. 11(*b*), a connector 41*a* may be attached to an end portion, which is at the side of the electronic device 35, of the cable 34. Furthermore, a connector (not shown) may be attached to the other end portion, which is at the side of the power radiation conductor 37, of the cable 41. Alternatively, connectors (not shown) may be attached to both of the end portions, which are at the sides of the electronic device 35 and the power radiation conductor 37, of the cable 41, respectively.

In these cases, the power radiation conductor 37 can be detached from the electronic device 35. Moreover, such electronic devices and antennas in these cases are convenient to carry.

Furthermore, the antenna body 11 (or 21) and the power radiation conductor 37 can be separated from each other in a range in which the electromagnetic coupling therebetween can be established. The power radiation conductor 37 can be oriented in a position wherein radio reception/transmission is optimum, by, for instance, attaching the power radiation conductor 37 to the casing 33 of the electronic device 35.

Incidentally, regarding the first to third embodiments, there has been described the case that the substrate of the antenna body comprises a dielectric material containing barium oxide, aluminum oxide and silica as major ingredients. However, the material of the substrate is not limited thereto. For example, another dielectric material whose ingredients are titanium oxide and neodymium oxide, a magnetic material whose ingredients are nickel, cobalt and iron, or a combination of a dielectric material and a magnetic material may be employed as the material of the substrate of the antenna body.

Further, although there has been described the case that the shape of the substrate of the antenna body is a rectangular prism, other shapes, for instance, a cube, a circular cylinder, a pyramid, a circular cone and a sphere may be employed as the shape of the substrate.

Furthermore, the provision of at least a single power radiation conductor suffices for practicing the antenna unit of the present invention. Additionally, the position of the power radiation conductor with reference to the position of the power supply conductor is not an indispensable condition for practicing the present invention.

Further, although there has been described the case that the shape of the cross section of each winding orthogonal to the winding axis C of the power supply conductor wound in a spiral is nearly rectangular, the shape of the cross section of the winding has only to contain a linear part. In this case, the antenna unit of the present invention responds to primary polarized waves, which come from the direction of the winding axis, and cross polarized waves which come from a direction perpendicular to the winding axis. Thus, the antenna unit of the present invention is a non-directional one.

Moreover, although there has been described the case that the power supply conductor of the antenna body is wound as a spiral, the power supply conductor may be formed as a meander conductor, e.g., sinusoidal, square or triangular wave shaped.

Furthermore, although there has been described the case that the power supply conductor is disposed in the substrate of the antenna body, the power supply conductor may be provided on the surface of the substrate of the antenna body. Alternatively, power supply conductors may be provided both on the surface of the substrate and in the substrate, respectively.

Additionally, although there has been described the case that the number of the power supply conductors provided in or on the antenna body is one, two power supply conductors or more may be provided therein. In such a case, the antenna unit can have a plurality of resonance frequencies.

Although there has been described the case that the power radiation conductor is a nearly rectangular metallic plate, the shape of the power radiation conductor is not limited to nearly rectangular. Further, similar advantages are obtained even if metallic foil or a mesh conductor is used instead of the metallic plate.

In addition, the positions of the power radiation conductor and the power supply terminal are not indispensable conditions for practicing the present invention.

Although preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. An antenna unit comprising:

an antenna body having a substrate comprising at least one of a dielectric material and a magnetic material;

at least one power supply conductor arranged in the substrate;

the antenna body having on a surface of said substrate at least one power supply terminal for applying a voltage to said power supply conductor; and a power radiation conductor provided in proximity to a surface of said substrate of said antenna body, the power radiation conductor being electrically isolated from the power supply conductor;

the substrate comprising a plurality of layers stacked on each other establishing a direction normal to the stacked layers; and said at least one power supply conductor being spirally arranged inside said substrate so as to have a spiral axis extending perpendicular to the direction normal to the stacked layers.

2. The antenna unit of claim 1, wherein portions of the power supply conductor are disposed on selected ones of the layers, at least one conductive through hole being provided on at least one of the layers, the layers being assembled together to form the substrate, the at least one conductive through hole joining the conductor portions to form the power supply conductor.

3. The antenna unit of claim 2, wherein the power supply conductor has a substantially rectangular shape in transverse cross section.

4. The antenna unit of claim 1, wherein the substrate comprises a dielectric material comprising barium oxide, aluminum oxide, and silica.

5. The antenna unit of claim 1, wherein the substrate comprises a dielectric material comprising titanium oxide and neodymium oxide.

6. The antenna unit of claim 1, wherein the substrate comprises a magnetic material comprising nickel, cobalt and iron.

7. The antenna unit of claim 1, wherein the substrate comprises a combination of a dielectric material and a magnetic material.

8. The antenna unit of claim 1, wherein the power radiation conductor is provided on the surface of the substrate.

9. The antenna unit of claim 1, wherein the power radiation conductor is at least one of an electrically conductive plate, electrically conductive foil and electrically conductive mesh.

10. The antenna unit of claim 1, wherein the power supply conductor has at least one linear part in transverse cross section.

11. The antenna unit of claim 1, wherein the substrate has a mounting surface for mounting on a printed circuit board, the power supply conductor comprising a spiral winding having a winding axis perpendicular to the mounting surface.

12. The antenna unit of claim 1, wherein the substrate has a mounting surface for mounting on a printed circuit board, the power supply conductor comprising a spiral winding having a winding axis parallel to the mounting surface.

13. An antenna unit comprising:

an antenna body having a substrate comprising at least one of a dielectric material and a magnetic material;

at least one power supply conductor arranged in the substrate;

the antenna body having on a surface of said substrate at least one power supply terminal for applying a voltage to said power supply conductor; and a power radiation conductor provided in proximity to an electronic device on which said antenna body is mounted, the power radiation conductor being electrically isolated from the power supply conductor;

the substrate comprising a plurality of layers stacked on each other establishing a direction normal to the stacked layers; and said at least one power supply conductor being spirally arranged inside said substrate so as to have a spiral axis extending perpendicular to the direction normal to the stacked layers.

14. The antenna unit of claim 13, wherein portions of the power supply conductor are disposed on selected ones of the layers, at least one conductive through hole being provided on at least one of the layers, the layers being assembled together to form the substrate, the at least one conductive through hole joining the conductor portions to form the power supply conductor.

15. The antenna unit of claim 14, wherein the power supply conductor has a substantially rectangular shape in transverse cross section.

16. The antenna unit of claim 13, wherein the substrate comprises a dielectric material comprising barium oxide, aluminum oxide, and silica.

17. The antenna unit of claim 13, wherein the substrate comprises a dielectric material comprising titanium oxide and neodymium oxide.

18. The antenna unit of claim 13, wherein the substrate comprises a magnetic material comprising nickel, cobalt and iron.

19. The antenna unit of claim 13, wherein the substrate comprises a combination of a dielectric material and a magnetic material.

20. The antenna unit of claim 13, wherein the power radiation conductor is provided on a casing of the electronic device.

21. The antenna unit of claim 13, wherein the power radiation conductor is at least one of an electrically conductive plate, electrically conductive foil and electrically conductive mesh.

22. The antenna unit of claim 13, wherein the power supply conductor has at least one linear part in transverse cross section.

23. The antenna unit of claim 13, wherein the substrate has a mounting surface for mounting on a printed circuit board, the power supply conductor comprising a spiral winding having a winding axis perpendicular to the mounting surface.

24. The antenna unit of claim 13, wherein the substrate has a mounting surface for mounting on a printed circuit board, the power supply conductor comprising a spiral winding having a winding axis parallel to the mounting surface.

25. The antenna unit of claim 13, wherein the substrate is mounted on a printed circuit board of the electronic device, the electronic device having a radio frequency control portion, the power supply conductor of the antenna unit being coupled to the radio frequency control portion through a transmission line.

26. The antenna unit of claim 13, wherein the electronic device has two components, a carrying case portion housing the radio frequency control portion and a cover portion, the substrate having the power supply conductor and the power radiation conductor being disposed in the cover portion.

27. The antenna unit of claim 26, wherein the cover portion is movable with respect to the carrying case portion.

28. The antenna unit of claim 26, wherein the cover portion is detachable from the carrying case portion.

29. The antenna unit of claim 26, wherein the power radiation conductor is disposed in the cover portion and the substrate having the power supply conductor is disposed in the carrying case portion with the radio frequency control portion.

30. The antenna unit of claim 13, wherein the antenna unit comprising the power radiation conductor and the substrate with the power supply conductor is movable with respect to the electronic device and connectable to the electronic device by a cable.

31. The antenna unit of claim 13, wherein the power radiation conductor is separable from the substrate having the power supply conductor and connectable to the electronic device by a cable.

* * * * *